US005195792A

United States Patent [19]

Stendal

[11] Patent Number: 5,195,792

[45] Date of Patent: Mar. 23, 1993

[54] ELECTRICALLY OPERATED SECURING PLATE FOR DOOR LOCKS

[75] Inventor: Jan Stendal, Västerås, Sweden

[73] Assignee: Stendals Elektriska AB, Västerås, Sweden

[21] Appl. No.: 761,955

[22] PCT Filed: Mar. 2, 1990

[86] PCT No.: PCT/SE90/00138

§ 371 Date: Sep. 20, 1991

§ 102(e) Date: Sep. 20, 1991

[87] PCT Pub. No.: WO90/11422

PCT Pub. Date: Oct. 4, 1990

[30] Foreign Application Priority Data

Mar. 21, 1989 [SE] Sweden ..... 8900988

[51] Int. Cl.[5] ..... E05B 47/00

[52] U.S. Cl. ..... 292/341.16

[58] Field of Search ..... 292/341.16, 341.17, 292/201

[56] References Cited

U.S. PATENT DOCUMENTS

| | | | |
|---|---|---|---|
| 3,325,203 | 6/1967 | Moler | 292/201 |
| 3,521,921 | 7/1970 | Miyazaki | 292/201 |
| 3,796,452 | 3/1974 | Foster et al. | 292/341.16 |
| 3,861,727 | 1/1975 | Froerup et al. | 292/341.16 |
| 4,026,589 | 5/1977 | Hanchett | 292/341.16 |
| 4,302,039 | 11/1981 | Dukel et al. | 292/341.16 |
| 4,406,487 | 9/1983 | Stendal | 292/201 |
| 4,756,566 | 7/1988 | Logas | 292/341.16 |
| 4,986,584 | 1/1991 | Logas | 292/341.16 |

FOREIGN PATENT DOCUMENTS

| | | |
|---|---|---|
| 0284589 | 9/1988 | European Pat. Off. . |
| 1321834 | 7/1973 | United Kingdom . |

*Primary Examiner*—Richard E. Moore

*Attorney, Agent, or Firm*—Dennison, Meserole, Pollack & Scheiner

[57] ABSTRACT

A locking device for doors and the like comprising a housing (1) containing a securing plate (8) and ratchet means (19, 20) cooperating therewith to optionally retain the securing plate in locked position. The securing plate is pivotable about a spindle (10) and arranged to be moved between open and closed position by the bolt and to remain in one or other of these positions. According to the invention the device also includes an indicator in the form of a cam (11) with a pin, designed to cooperate with the securing plate in sensing the position of the bolt in relation to a limit breaker or the like when the securing plate is in closed position.

13 Claims, 4 Drawing Sheets

ELECTRICALLY OPERATED SECURING PLATE FOR DOOR LOCKS

Figure 1:
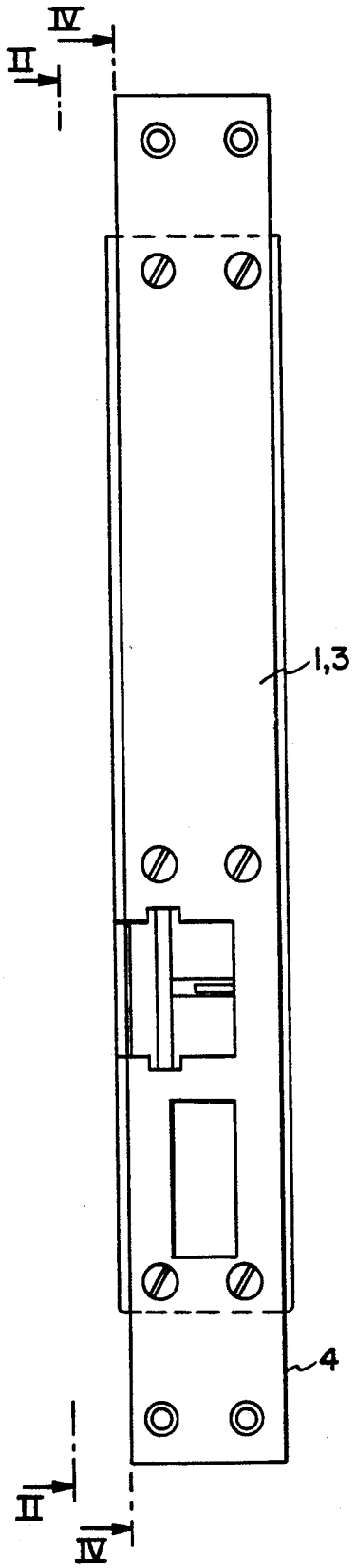

The present invention relates to a locking device for doors and the like comprising a housing and ratchet means cooperating therewith to optionally retain the securing plate in locked position, the plate being pivotable about a spindle and arranged to be moved between open and closed position by the bolt and to remain in one or other of these positions. With previously known electrically operated securing plates the door lock must consist of a spring-loaded, descending bolt with angle-cut end face, which is not considered as reliable as a sliding bolt.

Assurance is also desired that the lock has assumed its final position and that the bolt has reached its innermost or outermost position, respectively, as there may otherwise be some uncertainty as to this. Sensing the status of the lock is thus desirable.

These and other similar problems are solved by the present invention which is characterised in that the device also includes an indicator in the form of a cam with a pin, designed to cooperate with the securing plate in sensing the position of the bolt and conveying this information to a limit breaker or the like when the securing plate is in closed position.

The securing plate is pivotable about a spindle, the closing and opening movements of the plate occurring during rotation about the spindle and the centre of rotation being so located that the securing plate is moved aside by pressure from the bolt, for instance, when the door is opening or closing.

According to a preferred embodiment of the invention the securing plate and a pivotable cam are journalled on the same spindle, a pin on the cam cooperating with the securing plate and transmitting information to a microswitch or the like as to whether the bolt inside the locking device is locked in the securing plate. This cam is also forcibly guided by the securing plate, the cam being pushed to its innermost position by the pressure of the securing plate against the cam pin when the door is opened.

This enables the bolt to enter the securing plate upon closing, without touching the cam.

According to another embodiment of the invention, the securing plate is also arranged so that the ratchet is unable to lock the plate when the plate is in open position, i.e. when the door is open.

The ratchet can only lock the securing plate when the door is closed, i.e. when the bolt has forced the securing plate to closed position and the ratchet falls by its own weight to its lowermost position in the recess in the securing plate.

To prevent unauthorized lifting or picking of the ratchet itself, said ratchet is provided with a link having an inclined groove for engagement with the lifting pin of the ratchet, said pin being designed so that if the upper, jointed part of the link is lifted by an electromagnet, for instance, the protruding portion of the link below the stop will be exposed first, thus permitting continued movement upwards (unlocking) of the ratchet. Furthermore, the inclined groove is arranged to effectively force the protruding part of the link to an end position against a stop if any unauthorized attempt is made to open the lock by lifting the ratchet itself, e.g. in the event of sabotage.

Figure 2:
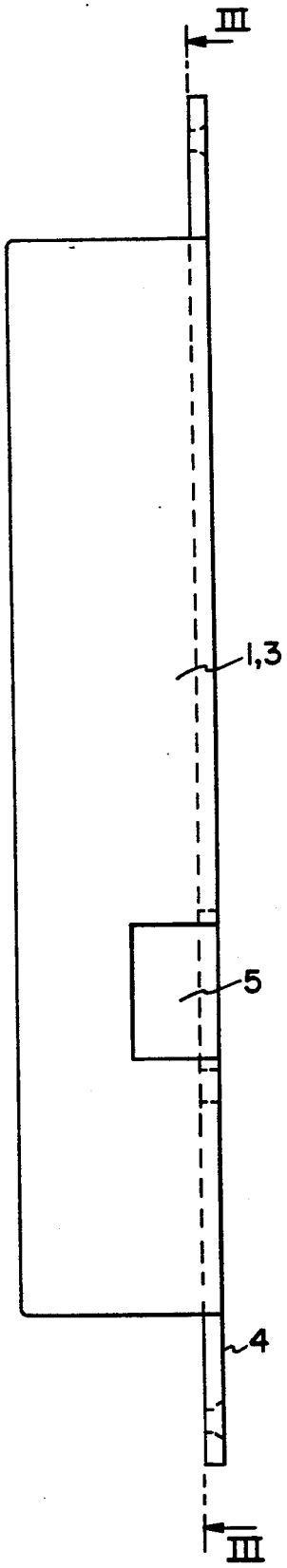
Figure 3:
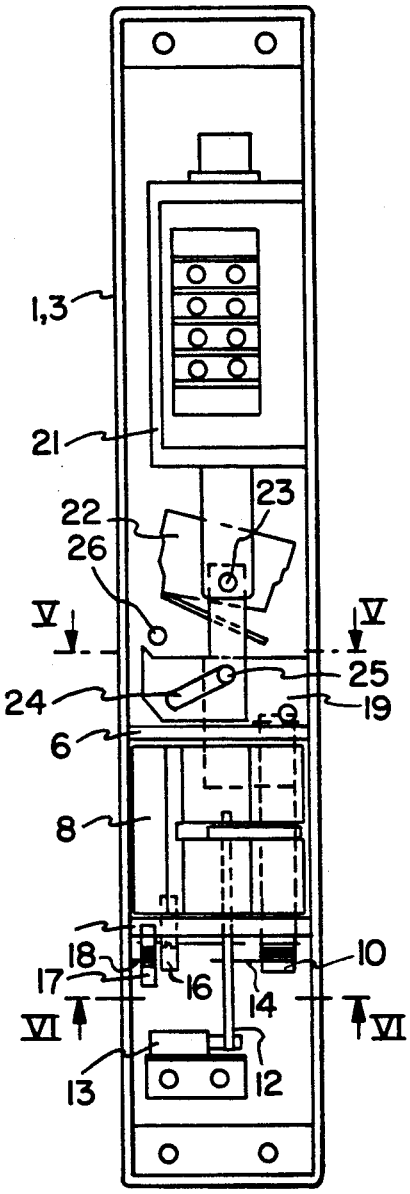
Figure 4:
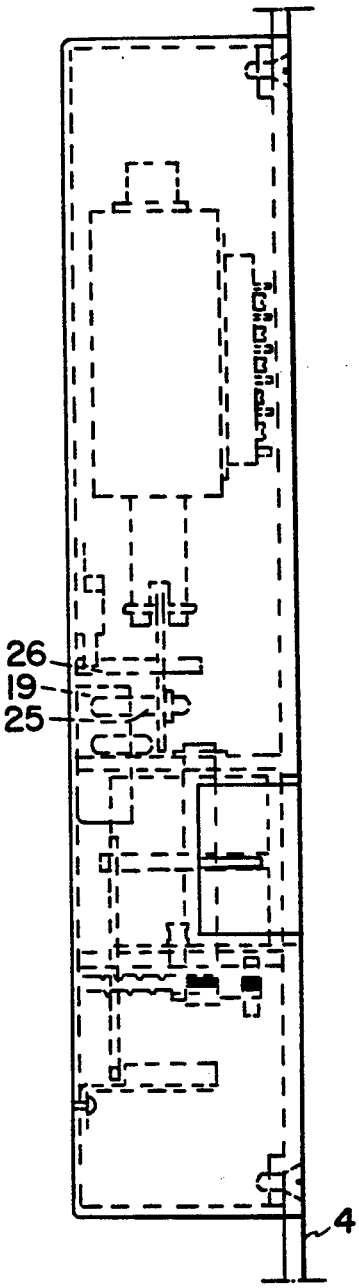
Figure 5:
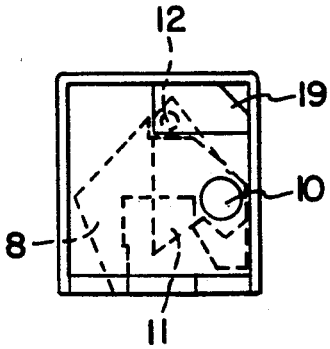
Figure 6:
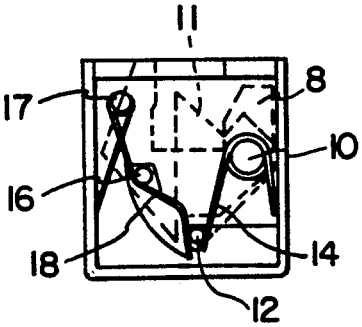
Figure 7:
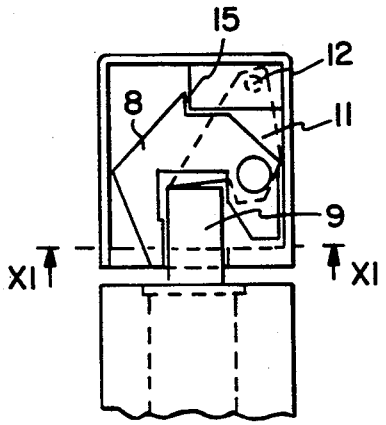
Figure 8:
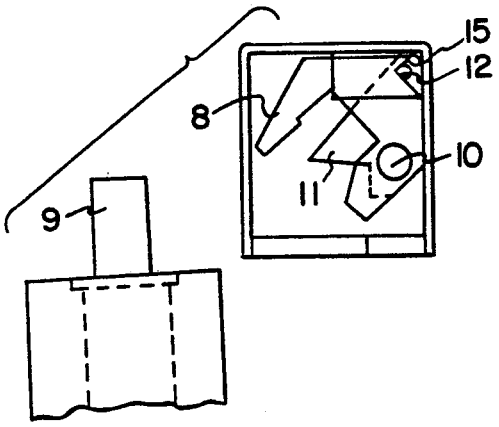
Figure 9:
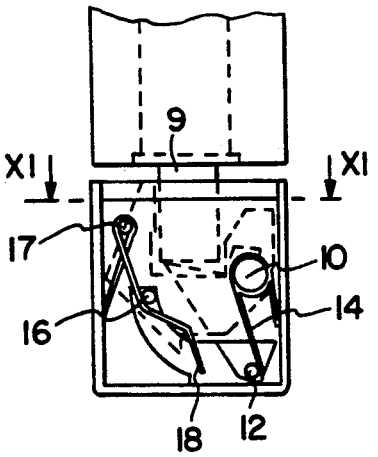
Figure 10:
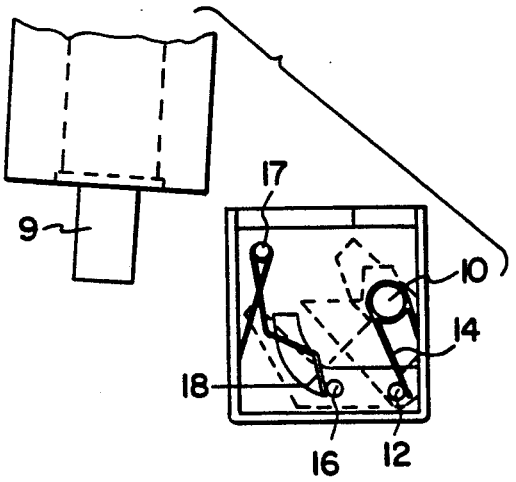
Figure 11:
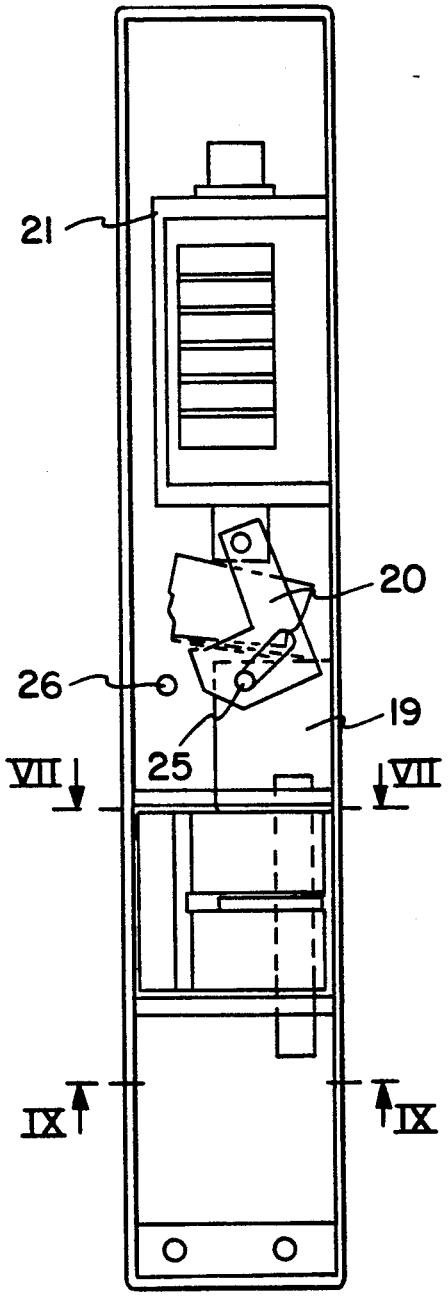

The invention will be described in the following with reference to the accompanying drawings in which FIG. 1 shows a frontal view of a lock, FIG. 2 shows a side view in the direction II—II, FIG. 3 shows a cross section along the lines III—III in FIG. 2 (door closed, bolt inoperative), FIG. 4 shows a cross section along the lines IV—IV in FIG. 1 (door closed, bolt inoperative), FIG. 5 shows a cross section along the lines V—V in FIG. 3 (closed door, bolt inoperative), FIG. 6 shows a cross section along the lines VI—VI in FIG. 3 (closed door, bolt inoperative), FIG. 7 shows a cross section along the lines VII—VII in FIG. 11 (closed door, bolt in operation), FIG. 8 shows a cross section along the lines VII—VII in FIG. 11 open door, bolt in operation), FIG. 9 shows a cross section along the lines IX—IX in FIG. 11 closed door, bolt in operation), FIG. 10 shows a cross section along the lines IX—IX in FIG. 11 open door, bolt in operation), and FIG. 11 shows a cross section along the lines XI—XI in FIGS. 7 and 9 (ratchet disengaged).

FIG. 1 shows an electrically operated securing plate in a lock housing fitted in a door-frame. The housing is composed of a casing 3 and a lid 4 with a side opening 5 to receive the bolt 9 from the door lock. The lid is provided with assembly screws for fitting to door-frame and casing. These screws are hidden by the door when the door is closed and can therefore only be removed when the door is open.

The lock housing is shown in more detail in FIG. 3.

The casing 1 is provided with two partitions 6 and 7 and in the space between these is a securing plate 8. This plate is provided with a recess for the bolt 9 of the door lock.

The securing plate 8 is so arranged that by pressing against a side wall of the plate recess during a closing movement the bolt 9 will force the securing plate 8 from the open door position shown in FIG. 8 to the closed door position in FIG. 7. It is also arranged so that by pressing against a side wall of the plate recess during an opening movement, the bolt 9 will force the securing plate from the position shown in FIG. 7 to that shown in FIG. 8.

The securing plate is also provided with a recess for a cam 11 journalled on the same spindle 10 to indicate via a pin 12 or the like to a microswitch 13 when the cam, applied on the spindle by a torsion spring 14, strives towards the position shown in FIG. 6, i.e. when the bolt 9 is unlocked i.e. not extended.

The lock is also provided with a recess 15 to grasp the pin 12 and forcibly guide the cam to its innermost position as shown in FIG. 8, when during a door opening movement the securing plate is forced by the door bolt to the open position shown in FIG. 8.

During a subsequent closing movement of the door, the bolt can then be inserted into the lock housing without encountering the outermost part of the cam 11. However, only when the securing plate 8 has reached the position shown in FIG. 7 can the microswitch 13 sense whether the door bolt is in locking position or not.

To retain the securing plate 8 in open position, i.e. in the position shown in FIG. 8, and to counteract the pressure of the cam 11 against the securing plate via torsion spring 14, the securing plate 8 has been provided with a pin 16 which is influenced by a torsion spring 18 and pin 17 located on the lower partition 7. The spring 18 has greater force than that exerted in the opposite direction by the torsion spring 14 via the cam 11.

The torsion spring 18 influencing pin 16 on the securing plate is angled as shown in FIGS. 9 and 10, and thereby strives to keep the securing plate in closed or open position, respectively.

A ratchet 19 is located in the casing and is operated via a link 20 from an electromagnet 21. The ratchet 19 can only lock the securing plate when the door is closed and the extended bolt 9 has forced the securing plate to its closed position.

Upon unlocking, i.e. when current is connected, the electromagnet 21 is arranged to draw up the armature, connected via a link 20 to the ratchet, so that the securing plate is disengaged from the ratchet.

A microswitch 22 senses via its operating arm when the ratchet 19 is lifted, i.e. the securing plate is disengaged.

The uppermost part of link 20 pivots on shaft 23 of the electromagnet armature and its lowermost part is provided with an inclined groove to engage with the lifting pin 25 designed so that raising the electromagnet in the upper joint 23 will first disengage the part of the link protruding below the stop or pin 26, thereby enabling continued lifting (unlocking) of the ratchet to the disengaged position shown in FIG. 11.

Furthermore, the inclined groove 24 is arranged to effectively force the protruding part of the link to an end position against a stop or pin 26 if any unauthorized attempt is made to open the lock by lifting the ratchet itself, e.g. in the event of sabotage.

The invention can be varied in many ways within the scope of the appended claims.

I claim:

1. A locking device for doors comprising: a housing (1), a securing plate (8) having side walls forming a recess, ratchet means (19, 20) located in said housing for selectively retaining said securing plate in a locked position, an extendable bolt (9) in the door, said bolt when extended pressing against one side wall to force the securing plate from an unlocked position to a locked position during a door closing movement, pressing against another securing plate side wall to force the securing plate from a locked position to an unlocked position during a door opening movement, and indicator means in the form of a cam (11), pin (12), microswitch (22) for cooperation with said securing plate to sense whether or not the bolt is in an extended position, said securing plate and cam (11) being journalled on a common spindle (10).

2. The locking device according to claim 1, wherein the securing plate (8) grips said pin (12) during the door opening movement, thereby forcing the pin to its limit position.

3. The locking device according to claim 1, further including an electromagnet for operating said ratchet means to prevent door opening by engaging the securing plate into the locked position after the door is closed and the extended bolt has forced the securing plate to its locked position.

4. The locking device according to claim 3, wherein the ratchet means (19,20) is arranged to block rotation of the securing plate about the spindle (10) until said ratchet means is disengaged by the electromagnet.

5. The locking device according to claim 4, including a torsion spring (18) designed to keep the securing plate (8) in closed or open position, respectively.

6. The locking device according to claim 5, wherein the housing is provided with two partitions (6,7).

7. The locking device according to claim 6, wherein said torsion spring (18) is arranged on the cam (11) and pin (12) to influence said microswitch and to indicate whether the bolt is locked or unlocked.

8. The locking device according to claim 3 wherein current is applied to said electromagnet whereby said ratchet means are operated to disengage said securing plate to the unlocked position to permit opening of the door.

9. The locking device according to claim 1, wherein a side wall of the recess in the securing plate is provided with a step-formed recess for facilitating the movements of the securing plate (8).

10. The locking device according to claim 1 wherein the ratchet means includes a ratchet (19) and a link (20).

11. A locking device as claimed in claim 10 wherein the housing is provided with two partitions (6,7).

12. The locking device according to claim 11, including a torsion spring 18 arranged on the cam (11) and pin (12) to influence said microswitch and to indicate whether the bolt is locked or unlocked.

13. The locking device of claim 3, wherein the ratchet means includes a link (20) and a ratchet (19), the electromagnet has an armature provided with an inclined groove (24) to engage with a lifting pin (25) whereby operation of the electromagnet first disengages part of the link protruding below a step in pin (26) thereby disengaging the ratchet and permitting the door to open.

* * * * *